US008797033B1

(12) United States Patent
Girrell et al.

(10) Patent No.: US 8,797,033 B1
(45) Date of Patent: Aug. 5, 2014

(54) STRESS DETECTION TOOL USING MAGNETIC BARKHAUSEN NOISE

(75) Inventors: Bruce I. Girrell, Traverse City, MI (US); Thomas A. Johnson, Interlochen, MI (US); Ameet V. Joshi, Playa Vista, CA (US); Douglas W. Spencer, Williamsburg, MI (US); Gaurav D. Kulkarni, Williamsburg, MI (US); David J. Henderson, Traverse City, MI (US)

(73) Assignee: Microline Technology Corporation, Traverse City, MI (US)

( * ) Notice: Subject to any disclaimer, the term of this patent is extended or adjusted under 35 U.S.C. 154(b) by 326 days.

(21) Appl. No.: 13/253,600

(22) Filed: Oct. 5, 2011

Related U.S. Application Data

(63) Continuation-in-part of application No. 12/245,054, filed on Oct. 3, 2008, now Pat. No. 8,035,374.

(60) Provisional application No. 60/977,793, filed on Oct. 5, 2007.

(51) Int. Cl.
*G01V 3/00* (2006.01)

(52) U.S. Cl.
USPC ..... 324/318; 324/309

(58) Field of Classification Search
USPC ..... 324/300–322; 600/409–445
See application file for complete search history.

(56) References Cited

U.S. PATENT DOCUMENTS 2,814,019 A 11/1957 Bender
3,667,035 A 5/1972 Slichter
3,942,373 A 3/1976 Rogers
3,994,163 A 11/1976 Rogers
4,105,071 A 8/1978 Nicolas et al.
4,207,765 A 6/1980 Kiff
4,351,186 A 9/1982 Moulin
4,352,065 A 9/1982 Rogachev et al.
4,444,050 A 4/1984 Revett
4,708,204 A 11/1987 Stroud
4,719,803 A 1/1988 Capelle et al.
4,766,764 A 8/1988 Trevillion
4,966,234 A 10/1990 Whitten
5,004,724 A * 4/1991 De ..... 505/162
5,172,480 A 12/1992 Labuc et al.
5,375,476 A 12/1994 Gray
5,520,245 A 5/1996 Estes
5,720,345 A 2/1998 Price et al.
6,288,535 B1 9/2001 Chass
6,583,617 B2 * 6/2003 LeVert et al. ..... 324/235
6,851,476 B2 2/2005 Gray et al.
6,854,336 B2 2/2005 Buttle (Continued)

*Primary Examiner* — Brij Shrivastav

(74) *Attorney, Agent, or Firm* — Gardner, Linn, Burkhart & Flory, LLP

(57) ABSTRACT

A stress detecting system and method operable to detect stresses in a conduit or pipe includes a tool movable along a conduit or pipe and operable to generate a magnetic field. The tool is operable to sense magnetic Barkhausen noise within the conduit, such as within a wall of the conduit, in response to the tool generating the magnetic field. The stress detecting system is operable to detect a change in stress along the conduit responsive to an output of the tool. The system may detect changes in stress that are caused by geological changes or shifting or thermal changes at or near the conduit to determine changes in stress along the conduit and changes in stress along the conduit over time and during use of the conduit.

22 Claims, 13 Drawing Sheets

(56) References Cited

U.S. PATENT DOCUMENTS

| | | | | |
|---|---|---|---|---|
| 7,038,444 | B2 | 5/2006 | Crouch et al. | |
| 7,116,182 | B2 | 10/2006 | Varsamis et al. | |
| 7,128,988 | B2 | 10/2006 | Lambeth | |
| 7,150,317 | B2 | 12/2006 | Barolak et al. | |
| 7,660,197 | B2 | 2/2010 | Barolak | |
| 8,035,374 | B1 | 10/2011 | Girrell | |
| 2002/0024337 | A1 * | 2/2002 | LeVert et al. | 324/235 |
| 2009/0003130 | A1 | 1/2009 | Barolak | |

* cited by examiner

STRESS DETECTION TOOL USING MAGNETIC BARKHAUSEN NOISE

CROSS REFERENCE TO RELATED APPLICATIONS

The present application is a continuation-in-part of U.S. patent application Ser. No. 12/245,054, filed Oct. 3, 2008, now U.S. Pat. No. 8,035,374, which claims the benefit of U.S. provisional application Ser. No. 60/977,793, filed Oct. 5, 2007, which is hereby incorporated herein by reference in its entirety.

BACKGROUND OF THE INVENTION

1. Technical Field of the Invention

The present invention relates to generally to a method of detecting and identifying the most beneficial point to part or cut well pipe in order to recover it from a well. More specifically, the present invention relates to a method and apparatus to determine the location of the point along a length of well pipe where the well pipe is bound by rock, mud, or cement.

2. Description of Related Art

The ability to locate the point at which a tubular is stuck within another or within a well bore is useful. An accurate determination of the location of a stuck point (also referred to as a "freepoint") makes it possible to position tools to conduct recovery operations. Prior art devices include a number of devices which are intended for down-hole deployment. Most of these tools require applying tension or torsion to the well pipe. By measuring certain characteristics before application of the force and during application of the force, a determination can be made regarding the location of the sticking point.

Such known devices typically fall into two general categories. One category of tools measures well pipe displacement when stress is introduced into the well pipe. For example, the well pipe may be stretched or twisted and physical distance measurements quantify the movement or displacement of the well pipe or a section of the well pipe when it is stretched or twisted. These measurements are used to calculate how much of the well pipe is above the freepoint. A second type of tools relies on the ability to detect changes in a well pipe characteristic other than displacement. Various such detection methods include Hall Effect devices, strain gauges, and devices measuring magnetic permeability.

An example of such a device is disclosed in U.S. Pat. No. 4,708,204. The device disclosed in U.S. Pat. No. 4,708,204 detects changes of magnetic permeability when a motive force, such as tension or torque, is applied to a well pipe. Another known device is disclosed in U.S. Pat. No. 4,766,764, which discloses a device that uses Hall Effect sensors to measure and compare the absolute magnetic strength in the well pipe.

SUMMARY OF THE INVENTION

The present invention relates to a freepoint detection tool and a sensor assembly for use in a freepoint detection tool. The present invention identifies regions of induced elastic deformation to identify a freepoint in a well pipe by using magnetic Barkhausen noise analysis.

According to an aspect of the present invention, a stress detecting system is operable to detect stresses in a conduit or pipe. The system includes a tool movable along a conduit or pipe and operable to generate a magnetic field. The tool (such as a Barkhausen noise detecting device of the tool) is operable to sense magnetic Barkhausen noise within a wall of the conduit in response to the tool (such as a magnetic element of the tool) generating the magnetic field. The stress detecting system is operable to detect a change in stress along the wall of the conduit responsive to an output of the tool. The system may detect changes in stress that are caused by geological changes or shifting or thermal changes at or near the conduit to determine changes in stress along the conduit and changes in stress along the conduit over time and during use of the conduit.

The stress detecting system may detect a change in stress along the conduit to determine parts of the conduit where stress is greater than at other parts of the conduit. The stress detecting system may compare a second stress profile of a conduit to a first or baseline stress profile to determine changes in stress along the conduit since the baseline stress profile was generated.

Therefore, the system and method of the present invention is operable to determine changes in stress along a conduit or pipe by using magnetic Barkhausen noise to detect and analyze the stress and strain within and along the conduit or pipe. The system and method of the present invention may detect increases in stress or higher stress points or regions along the conduit or pipe to facilitate repairs or the like at locations where high stress is detected. The system and method may detect stresses or changes in stress along a conduit or pipe (disposed in the ground) caused by geological shifts or changes or geothermal or other temperature changes at or near or in the conduit or pipe and/or the system and method may detect stresses or changes in stress along a conduit or pipe or structure (disposed at an offshore platform, such as an oil drilling rig or production platform or the like) caused by waves or currents or tide or wind or the like, and may provide an alert or output indicative of the stress detections and/or the like.

These and other objects, advantages, purposes and features of the present invention will become apparent upon review of the following specification in conjunction with the drawings.

BRIEF DESCRIPTION OF THE DRAWINGS

FIG. 18A is another simplified cross section of the jack-up drilling rig of FIG. 18A, showing an exaggerated effect of wind and ocean current acting on the jack-up rig.

DESCRIPTION OF THE PREFERRED EMBODIMENTS

Figure 1A:
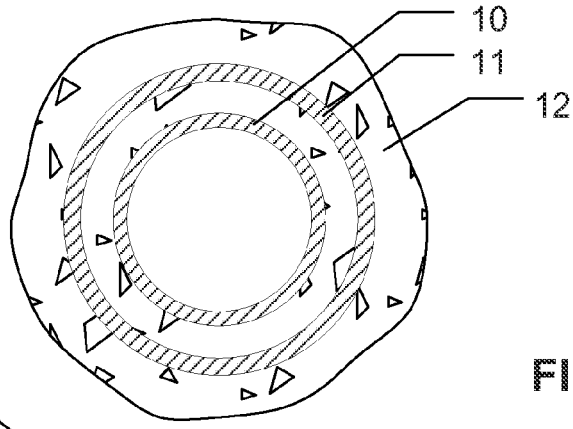
FIG. 1A shows a horizontal cross section of a well illustrating a freepoint.

The present invention provides a system and method for detecting the freepoint of a well pipe. The freepoint detection system of the present invention includes a freepoint detection tool that is deployable within a well pipe within a well casing within a well bore. The freepoint detection tool is comprised of a chassis, an electrical power source, control circuitry, a number of sensor assemblies, and data acquisition electronics. The freepoint detection tool is lowered into the well pipe and is operable to induce an alternating magnetic field into the pipe wall and to detect the magnetic Barkhausen noise that is correspondingly produced, in order to determine the location of the freepoint along the well pipe, as discussed below.

The need exists for petroleum producing companies to recover well pipe from oil wells. During drilling operations, drill strings sometimes become stuck for various reasons. Additionally, well pipes are sometimes cemented into place to prevent unwanted vertical migration of liquids within the well. When the well pipe is bound, whether by rock, mud or cement, the point at which the well pipe is stuck is called the freepoint. Whether the well pipe becomes stuck during drilling operations or is cemented into place for production purposes, locating the freepoint (the point where the well pipe is stuck below and free above) is a necessary process in order to recover as much of the well pipe as possible.

Determining the exact location of the freepoint is sometimes difficult. In the past, a number of devices have been used to locate the freepoint. Various techniques are used, many of which rely on either pulling on the well pipe to stretch it or by applying torque to the well pipe. Methods of locating the freepoint by stretching or twisting the well pipe vary. Well pipe stretching or twisting methods typically rely on the sticking point acting as a restraint. Well pipe above the freepoint stretches or twists and well pipe below the freepoint remains fixed and does not stretch or twist or deform or distort.

Sometimes the well pipe is stretched to measure the total amount of stretch under a known load to calculate the freepoint. In some other situations, a tool is sent down the well to measure localized stretching. Such tools detect stretching by measuring between two points that are relatively close together. To measure the degree of stretch of the well pipe, the tool anchors itself to the well pipe, whereby anchors at the top and bottom of the tool secure opposite ends of a measuring device to the well pipe when the well pipe is in a relaxed state. When tension is applied to the well pipe, the measuring instrument stretches with the stretched well pipe to detect any stretching within the length of the tool.

With localized stretching methods, the tool is lowered into the well pipe to take measurements at regular intervals. At each interval, the tool is locked into place and the well pipe stretched and measured. Then the tension is removed from the well pipe, the tool released from the pipe wall, and the tool is lowered to the next testing point. The process is repeated until the tool descends below the freepoint, as indicated by a lack of stretching when the well pipe is put under tension. Below the freepoint, the well pipe remains free of distortion regardless of whether the well pipe is under tension or not.

In addition to longitudinal stress (stretching), rotational stress can be employed when determining the location of the freepoint. By rotating the top of the well pipe, the stress induced into the well pipe can be measured with instruments such as strain gauges and the like. In a process similar to stretching techniques, a force is applied to the top of the well pipe. However, this method employs rotational force instead of a tensile force. Like the stretching method, the force applied to the well pipe is manifested throughout the portion of the well pipe from the point where the force is applied, down to the freepoint. The freepoint acts as a vice and grips the well pipe. Well pipe further down the hole remains relatively stress-free. Strain gauges, or other similar devices, are lowered into the well and monitored while rotational force is applied to the well pipe. When the instrument indicates a location where the strain suddenly drops off, it indicates the tool is below the freepoint.

Once the freepoint is located, the well pipe is typically cut or backed-off just above the freepoint. Once the well pipe above the freepoint is separated from the rest of the string, the remaining portion of the string can be removed through the use of specialized washing and fishing equipment.

Figure 1B:
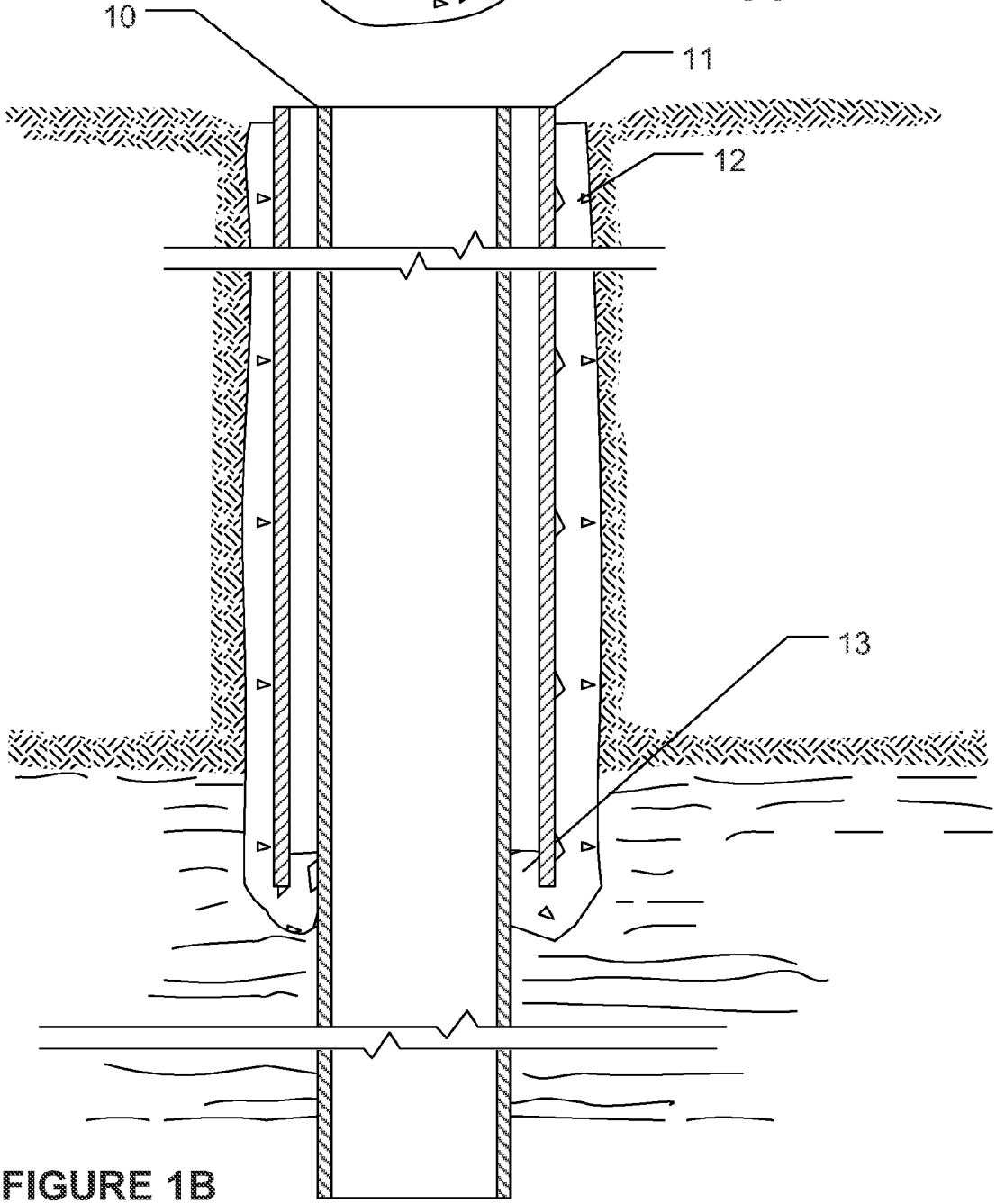
FIG. 1B shows a vertical cross section of the well of FIG. 1A.
Figure 2:
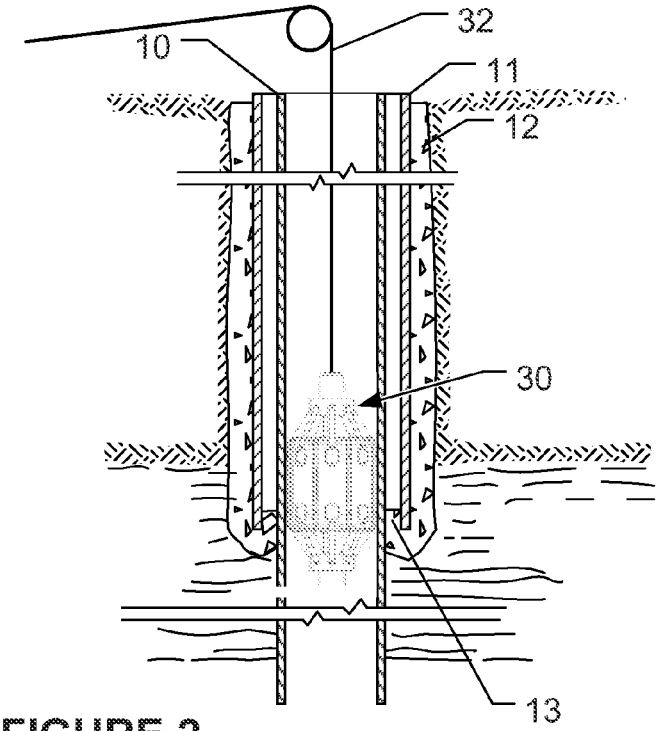
FIG. 2 depicts a freepoint detection tool of the present invention, as deployed in a well pipe.

Referring now to the drawings and the illustrative embodiments depicted therein, a freepoint detection system 100 of the present invention includes a freepoint detection tool or freepoint tool 30 that is lowerable into a well pipe 10 and that is operable to detect the location of the freepoint of the well pipe 10 (FIG. 2). As can be seen in FIGS. 1A, 1B and 2, the well pipe 10 may be disposed within a well casing 11 that is cemented or secured in place within a well bore, such as with cement 12 or the like. The cement at the lower end of the well casing may provide a cemented annulus 13 and may bind the well pipe 10. When the well pipe is bound, whether by rock, mud or cement, the point at which the well pipe is stuck is called the freepoint.

In the illustrated embodiment, freepoint tool 30 comprises a housing or chassis 26 (such as a generally cylindrical housing or frame of the illustrated embodiment) that houses or supports a plurality of sensor assemblies 20. As shown in FIGS. 3-7, each sensor assembly 20 includes a rotating electromagnetic coil 23 that is rotatable (such as via a rotational drive device or motor or stepper motor 21) to generate or induce an alternating magnetic field into the pipe wall (when the freepoint tool is disposed within the well pipe) to impart a reorientation of the magnetic domains within the ferromagnetic material of the pipe wall. The sensor assemblies 20 each include a sensor coil 25 that rotates with the electromagnetic coil 23 and detects the electrical impulses (magnetic Barkhausen noise or MBN) as the magnetic domains are being reoriented. The sensor assemblies 20 generate output signals that are received and processed to determine changes in the MBN detected to determine the location of the freepoint of the well pipe, as discussed below.

Description of the Components

As discussed above, each sensor assembly 20 of freepoint tool 30 comprises an electromagnetic coil 23 and a sensor coil 25. Each electromagnetic coil 23 is powered by a sine wave generator or oscillating power supply 24 operating at or around 12 HZ. Each sensor assembly 20 is attached to and/or driven by stepper motor 21 in order to rotate the electromagnetic coil and the sensor coil of the respective sensor assembly. When the freepoint tool 30 is located within a well pipe and the sensor assembly is activated, the rotating electromagnetic coil 23 induces an alternating magnetic field into the pipe wall at or near the sensor assembly, thereby causing a reorientation of the magnetic domains within the ferromagnetic material of the pipe walls. The sensor coil 25 rotates with the electromagnetic coil 23 and detects the electrical impulses (magnetic Barkhausen noise or MBN) as the magnetic domains are being reoriented.

Figure 10:
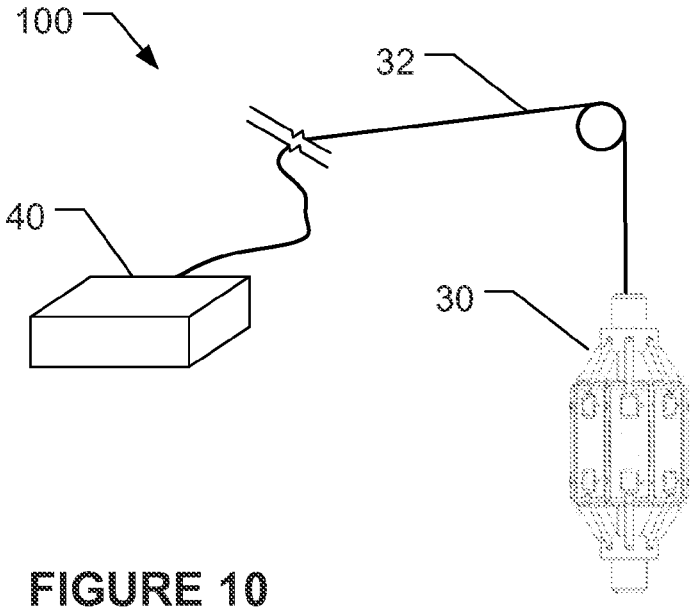
FIG. 10 depicts a freepoint detection tool of the present invention, as supported by a cable for deployment in a well pipe, with an electrical cable connecting the detection tool to a processing device or controller.

The magnetic Barkhausen noise is produced by the rapid and abrupt reorientation of the magnetic domains, thereby inducing high frequency current (3 kHz to 200 kHz) into the sensor coil 25. The sensor coil 25 is electrically connected to a signal processor 22, which may convert the electrical impulses into a digital signal and/or which may record the output of the sensor coil in a suitable format. The current induced into the sensor coil is preferably sampled at a rate higher than the Nyquist rate (typically about two times the bandwidth so as to define a lower bound for the sample rate for alias-free signal sampling) and recorded in a digital format. The onboard processor may store the data in memory for later analysis, or may transmit data (such as via a transmitter) to a remote control or processor 40, such as shown in FIG. 10, for current processing/analysis, while remaining within the spirit and scope of the present invention.

During operation of the freepoint detection system 100, an operator may monitor the incoming data in various ways. The data may be monitored graphically or as numeric values or other suitable monitoring means. Depending on the characteristics of the well pipe, various parameters, such as energy, frequency, amplitude and waveform and the like, may be analyzed to quantify stresses in the well pipe or to isolate the boundaries between stressed material and unstressed material.

Figure 3:
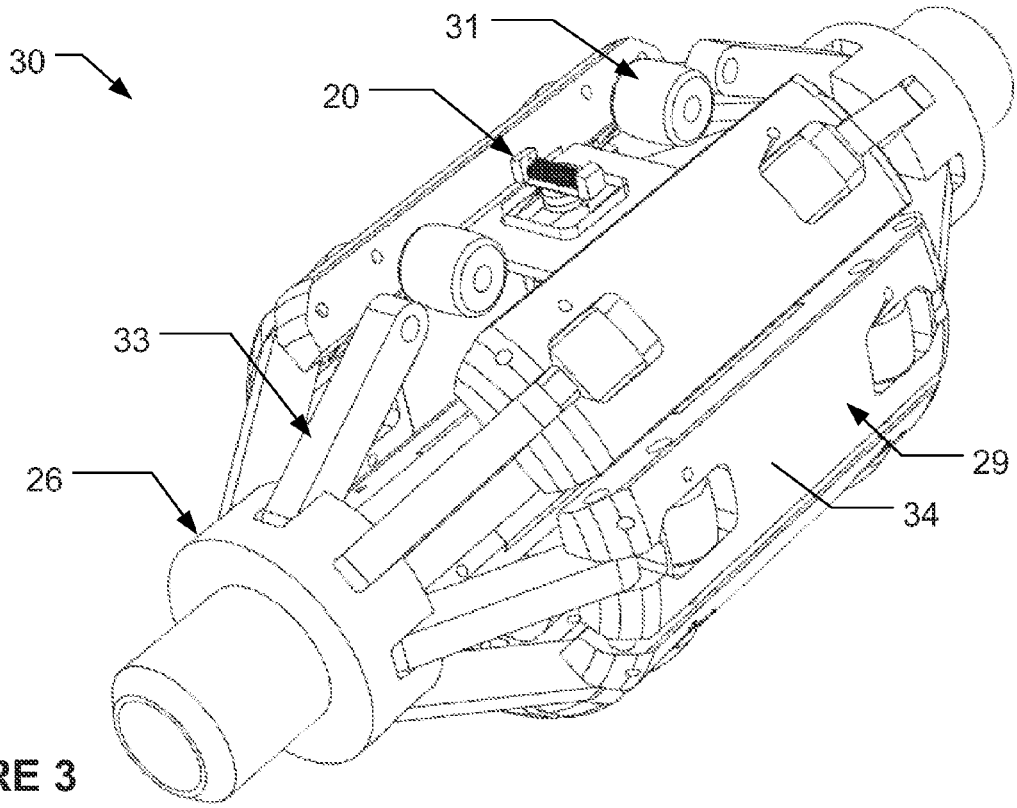
FIG. 3 is an isometric view of the freepoint detection tool of the present invention.
Figure 4:
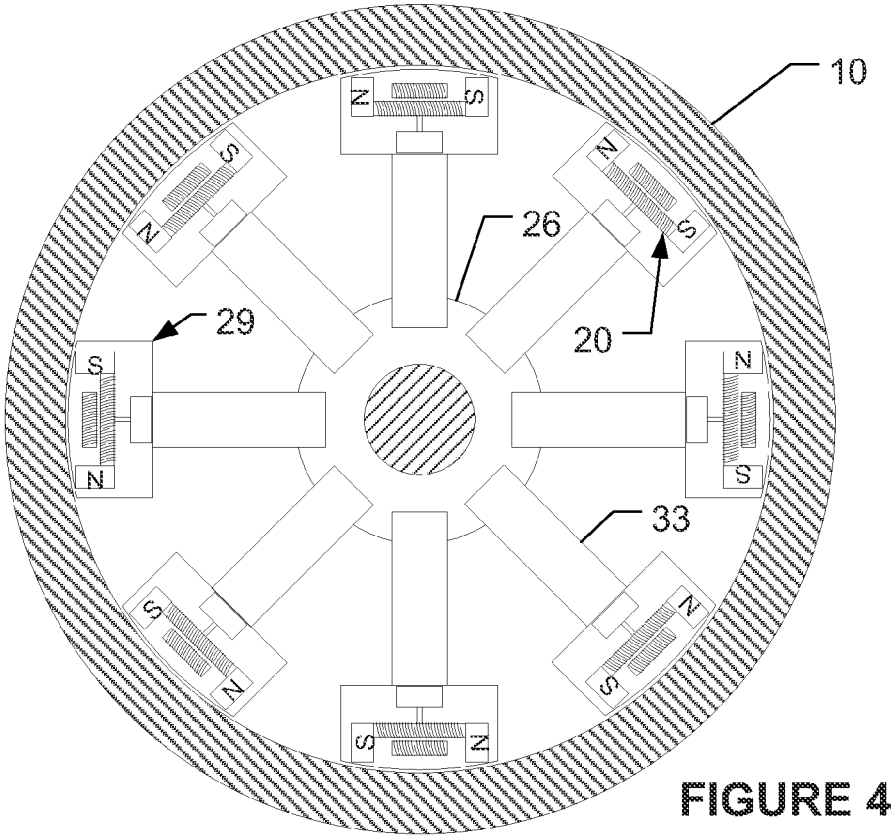
FIG. 4 is a cross sectional view of the freepoint detection tool of the present invention, as positioned inside a well pipe.
Figure 5:
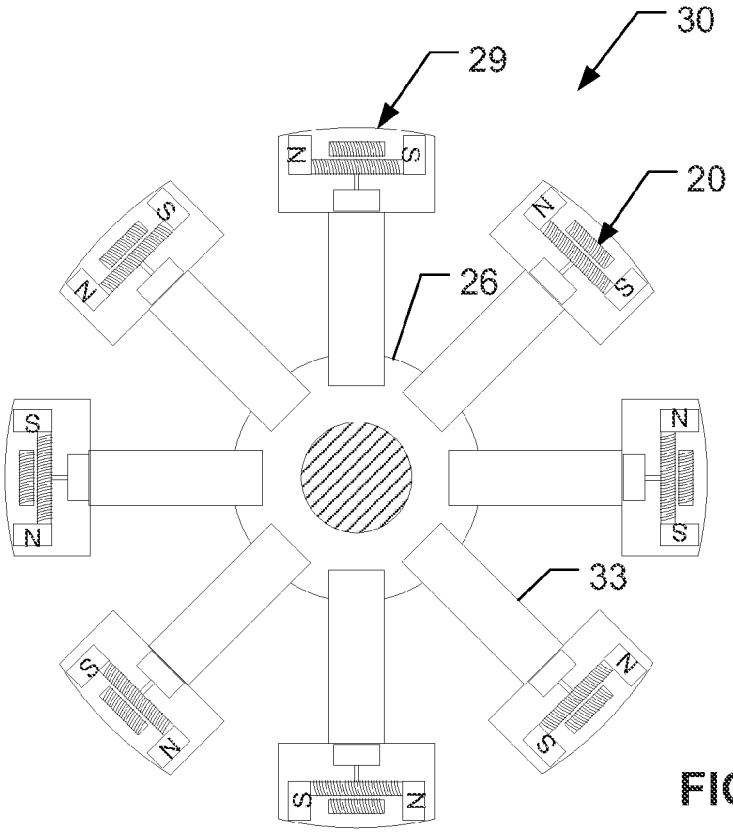
FIG. 5 is a cross section of a freepoint detection tool of the present invention, showing a preferred arrangement of rotating sensor assemblies.
Figure 6:
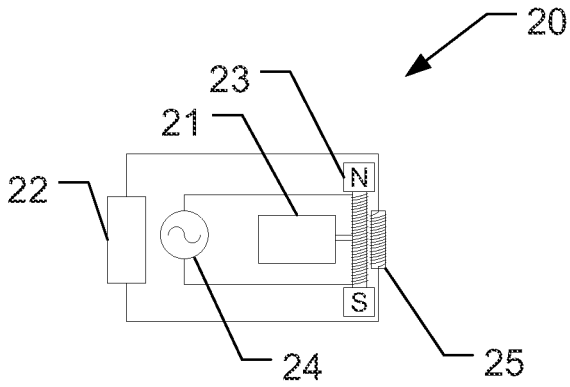
FIG. 6 is a schematic diagram of a magnetic Barkhausen noise sensor assembly for use in a freepoint detection tool in accordance with the present invention.
Figure 7:
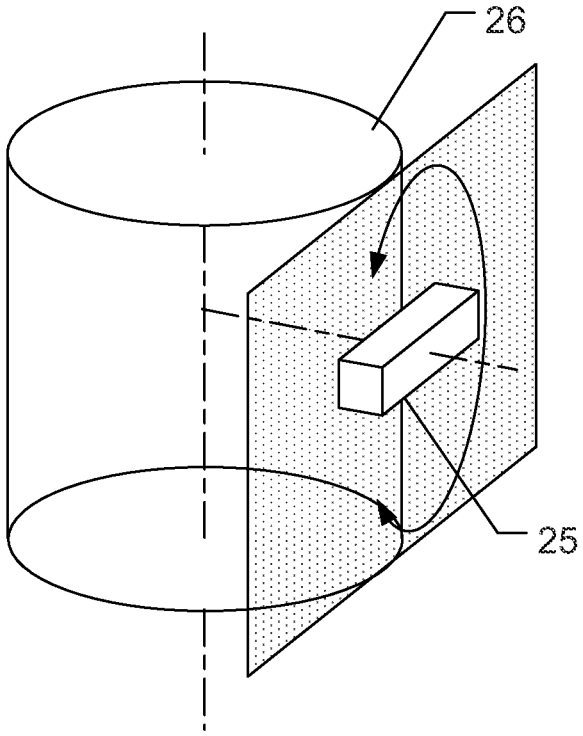
FIG. 7 is a conceptual view illustrating the rotational axis for fixed sensor placement.

The tool frame or chassis or housing 26 of freepoint detection tool 30 is designed or formed or constructed to position the sensor assemblies 20 close to the pipe wall without direct contact between the sensor and the pipe wall. In the illustrated embodiment, the tool housing or chassis 26 is a generally cylindrical housing or frame having an outer diameter that is less than the inner diameter of the well pipe to be analyzed, so that the tool may be received within the well pipe and readily moved along the well pipe. In the illustrated embodiment, the tool chassis 26 has a plurality of apertures at its outer wall or surface for receiving respective sensor assemblies, so that the electromagnetic coils and sensor coils are at or near the outer surface of the chassis and thus at or near the inner surface of the well pipe when the tool is received within the well pipe. As can be seen in FIGS. 2 and 3, the sensor assemblies are spaced apart circumferentially around the housing or chassis 26 so as to provide a generally horizontal row of spaced apart sensor assemblies at or near the outer surface of the freepoint tool 30.

In the illustrated embodiment, frame or chassis 26 of freepoint tool 30 includes or supports a plurality of movable or adjustable shoes 29, such as disposed about a perimeter or circumferential surface of the chassis 26. The shoes 29 may be spring-loaded or otherwise biased or configured to self-adjust in a radial direction from the centerline of the tool and toward engagement with the inner surface of the well pipe in which the detection tool is disposed. The shoes may be connected to the tool chassis by respective arms or mounting members 33 that allow for radial movement of the shoes relative to the chassis or frame.

The adjustable shoes allow the tool to pass through, or operate within, pipes with different inside diameters while keeping the tool centralized within the pipe and while keeping the sensor assembly or sensor assemblies 20 close to the pipe wall without direct contact between the sensor assembly and the pipe wall. The shoes are preferably closely aligned with the longitudinal axis of the tool so as to maintain the housing or chassis at or near the centerline of the well pipe in which the detection tool is disposed. As can be seen in FIG. 3, the sensor assemblies of the detection tool may be housed or disposed or contained within the shoes (such as within a shoe plate or sensor housing 34 of the respective shoe 29, with the plate being removed from one of the shoes in FIG. 3 to show additional details). The sensor assembly may be contained within the shoe plate or sensor housing (and at or near the outer surface of the sensor housing, or the sensor assembly may be disposed at or in or partially in a recess or aperture formed at the sensor housing (such as in a similar manner as sensor assemblies 120 of detection tool 130, discussed below). Optionally, the shoes 29 may be equipped with one or more rollers or wheels 31 rotatably mounted to the shoe plate or housing 34 to reduce or minimize friction between the shoe and the pipe wall as the detection tool moves along the well pipe, or the shoes may be equipped with any other suitable type of friction reducing device to reduce or minimize friction between the shoe and the pipe wall. The shoe assembly may be designed to maintain an optimal distance between the sensor assembly and the pipe wall as the detection tool is moved along the well pipe.

Figure 11:
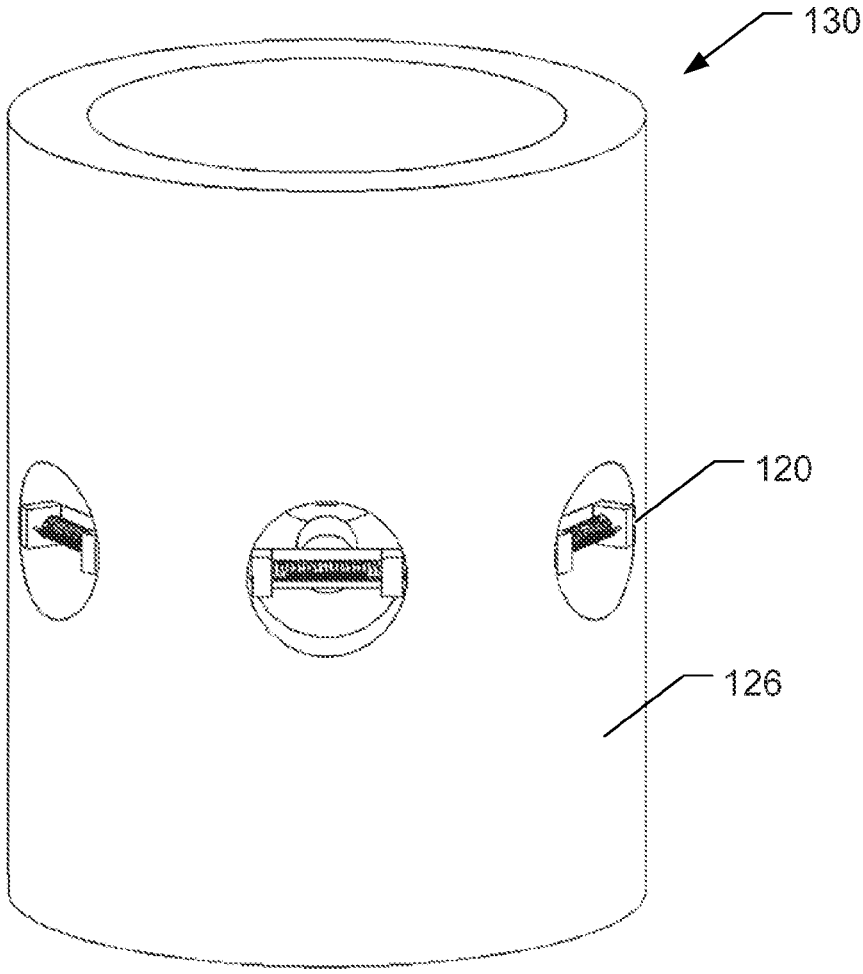
FIG. 11 is a perspective view of another freepoint detection tool of the present invention.
Figure 12:
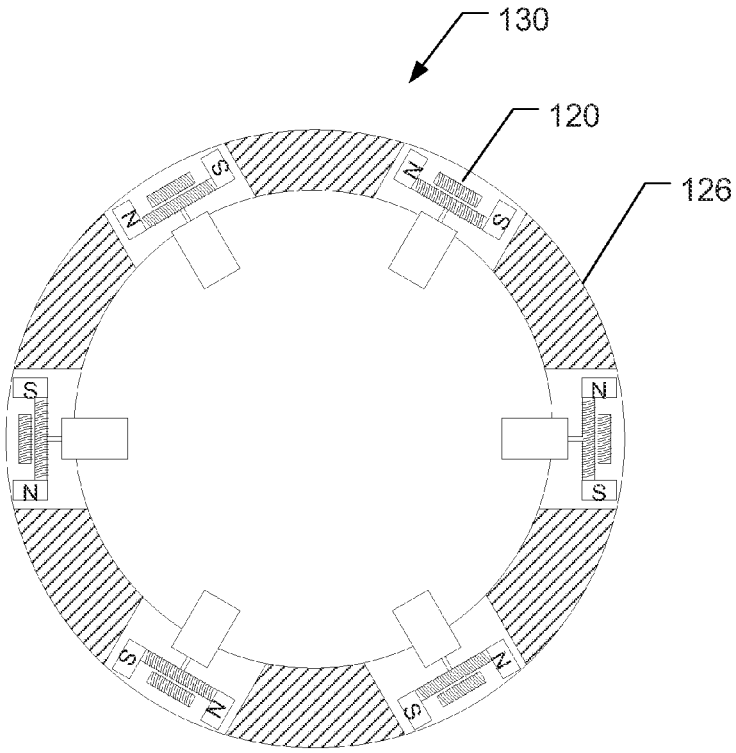
FIG. 12 is a sectional view of the freepoint detection tool of FIG. 11.

Although shown and described as having a housing with shoes and wheels or rollers to assist the detection tool in moving along the well pipe, it is envisioned that other housings or frames may be implemented with the detection tool while remaining within the spirit and scope of the present invention. For example, and with reference to FIGS. 11 and 12, a tool housing or chassis 126 of a detection tool 130 may comprise a generally cylindrical housing having an outer diameter that is less than the inner diameter of the well pipe to be analyzed, so that the tool may be received within the well pipe and readily moved along the well pipe. In the illustrated embodiment, the tool chassis 126 has a plurality of apertures at its outer wall or surface for receiving respective sensor assemblies 120, so that the electromagnetic coils and sensor coils are at or near the outer surface of the chassis and thus at or near the inner surface of the well pipe when the tool is received within the well pipe. As can be seen in FIGS. 11 and 12, the sensor assemblies are spaced apart circumferentially around the housing or chassis 126 so as to provide a generally horizontal row of spaced apart sensor assemblies at or near the outer surface of the freepoint detection tool 130.

The detection tool of the present invention is thus configured to be moved along the well pipe, such as via lowering and raising the tool via a cable or moving element 32 (FIG. 2), which may be attached to or connected to a winch or the like at an above ground level above or at or near the upper end of the well pipe. Optionally, the detection tool may be otherwise moved along the well pipe, such as via motorized rollers or wheels that engage the walls of the well pipe and that are rotatably driven to impart a translational movement of the tool along the well pipe. Optionally, the chassis may be equipped with rollers or slides or other devices or elements that function to keep the tool generally centrally located within the well pipe and to reduce or limit friction between the tool and the well pipe as the tool is moved along the well pipe, such as discussed above.

Optionally, and preferably, the freepoint detection tool may be equipped with a distance measuring device or odometer type device (such as, for example, a roller that engages the inner surface of the well pipe with control circuitry that monitors rotations of the roller to determine the distance traveled along the well pipe, or an altimeter type device that detects the altitude of the device, such as for substantially vertically oriented well pipes, or other distance or location detection means), which is operable to measure the distance that the tool travels along the well pipe or otherwise determine the location of the tool along the well pipe. Optionally, the odometer or distance or location input may also be used as a trigger or timing mechanism for data collection, such as for collecting data at regular intervals as the tool travels along the well pipe.

Operation of the System

During operation of the freepoint detection system of the present invention, the freepoint detection tool assembly is preferably lowered into a well or well pipe at a substantially constant rate. As the tool descends, the sensors detect and the instrument records the magnetic Barkhausen noise (MBN) as each electromagnetic coil and sensor coil assembly rotates relative to the tool chassis and the well pipe. The freepoint detection system collects the MBN data and processes the data (or provides the data to a user for human processing/analysis) to determine the location of the freepoint of the well pipe, as discussed below.

The freepoint detection system of the present invention relies on the freepoint tool's ability to induce an oscillating magnetic field into the steel well pipe. When a ferromagnetic material is applied with a magnetic field, the material becomes magnetized depending on its magnetic properties. The time and extent of magnetization might vary for different materials, but the process of magnetization always involves a corresponding occurrence of MBN. Magnetic Barkhausen noise occurs as tiny magnetic domains change orientation as a result of the induced magnetic fields. As the magnetic field changes, the magnetic domains seek a new orientation within the pipe wall. The changing orientation of each magnetic domain changes the magnetic field around it, and the changing magnetic field induces a current in the sensor coil that is located at or close to the pipe wall. Such induced current is commonly referred to as MBN. The freepoint detection system of the present invention records the MBN, which can be subsequently analyzed using software, or which can be output or represented or displayed in a format that allows for human analysis of the system output.

Figures 8A, 8B, 8C:
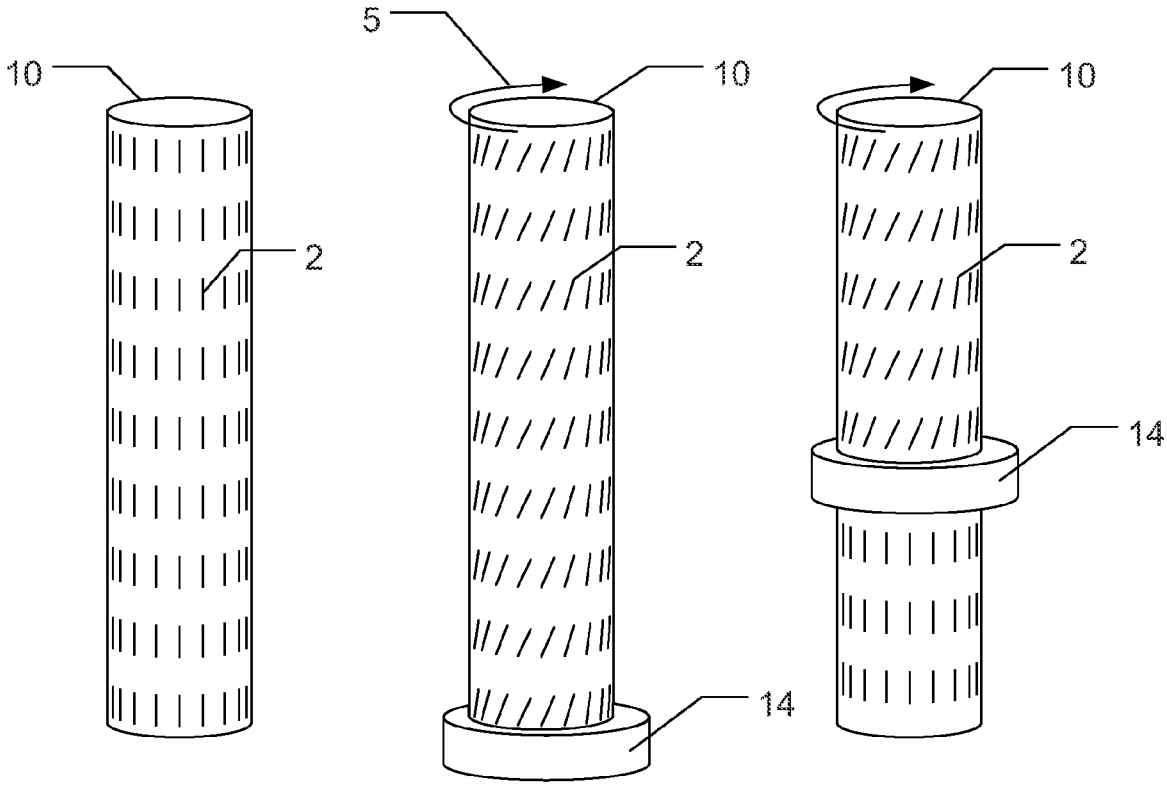
FIGS. 8A-C are conceptual diagrams of the alignment of the magnetic easy axis, with FIG. 8A showing a well pipe without an external force applied to the well pipe, FIG. 8B showing rotational stress applied to the well pipe and the effect of the stress on the magnetic easy axis, and FIG. 8C showing a well pipe with a freepoint midway along the well pipe.

In a cylindrical well pipe, such as well pipe 10, the magnetic domains are typically arranged generally along the axial direction of the well pipe. Although the domains are arranged along the axis of the well pipe, the North and South poles are randomly oriented. As a result, the well pipe does not exhibit any magnetism. However, when a magnetic field is induced into the well pipe, those magnetic forces attempt to magnetize the well pipe. In these situations, the well pipe tends to have the strongest magnetism in axial direction. This direction is called the "magnetic easy axis" (MEA) of the well pipe. As shown in FIG. 8A, the MEA 2 of the well pipe 10 is oriented along the longitudinal axis of the well pipe when the well pipe is in a non-stressed condition or substantially non-stressed condition. To determine the MEA, the sensor coil is rotated 360 degrees at a fixed location and MBN is recorded throughout the rotation. The angle of the sensor at which the MBN is the highest is called the MEA.

Ideally, the instrument would remain stationary during a full revolution of the sensor coils, in order to provide a full sensor revolution at each location along the well pipe. However, from an operational standpoint, it is preferable to translate or move the instrument or tool through the well pipe at a slow, but constant or substantially constant rate or velocity. To obtain the best results, the sensor assembly may be rotated at a high rate while the speed of translation of the tool along the well pipe is proportionally slow, thereby providing results that approximate the results that would have been obtained if the tool were stationary for each rotation of the sensor assembly.

When a well pipe is under stress, the magnetic easy axis (MEA) of the well pipe rotates away from the longitudinal axis. For example, and with reference to FIG. 8B, the MEA is shown at an angle relative to the longitudinal axis of the well pipe when the well pipe is under a rotational or torsional stress (such as in response to a rotational force 5 or the like). This reoriented MEA may be determined or computed utilizing the aforementioned method of MBN inspection. As can be seen in FIG. 8C, if there is a physical restraint 14 at the well pipe (such as at the freepoint of the well pipe), the well pipe above the restraint or freepoint 14 is stressed and has its MEA angled relative to the longitudinal axis of the well pipe, while the well pipe below the restraint or freepoint 14 is unstressed or less stressed and has its MEA oriented generally along the longitudinal axis of the well pipe.

To employ the principle of magnetic Barkhausen noise detection in the field of locating a freepoint in an oil well, the freepoint device 30, which is capable of inducing the magnetic field into the well pipe and simultaneously detecting the resulting magnetic Barkhausen noise, as discussed above, is lowered into the well pipe 10 with the well pipe in a non-stressed or less stressed condition. During the tool's descent along the well pipe (with the electromagnetic coils rotating to induce the magnetic fields and with the sensor coils sensing the corresponding MBN as described above), the data is recorded in an electronic log and stored for analysis. The process is continued until the tool is lowered to a location that is presumed to be at or below the expected freepoint of the well pipe.

With the tool is lowered below the expected freepoint, the well rig (or other deformation device or means) may be used to induce stress into the well pipe, such as by either pulling at the upper portion of the well pipe to elastically stretch the well pipe above the freepoint, or applying a rotational force at the upper portion of the well pipe to twist the well pipe above the freepoint, or a combination of the two. As the drilling rig applies stress to the well pipe, the well pipe and its joints above the freepoint undergo a slight elastic deformation or distortion (either longitudinal deformation if the well pipe is pulled or stretched or rotational deformation if the well pipe is twisted or rotated). The section or sections of the well pipe below the freepoint is/are insulated from the rotational and/or pulling forces and remain in a relative state of relaxation or remain in an unstressed condition.

Figure 13:
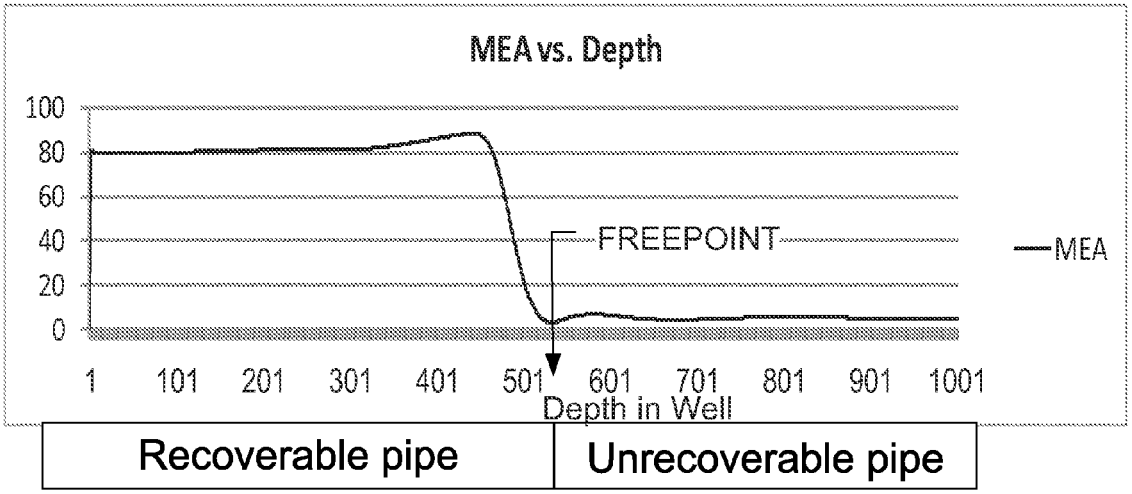
FIG. 13 is a graph of theoretical MEA data illustrating the depth of a freepoint of a well pipe.

After the well pipe is stressed and while the well pipe remains stressed or stretched or twisted (and is thus more stressed than the unstressed or less stressed condition), the freepoint tool is then raised upward along the well pipe (with the electromagnetic coils again rotating to induce the magnetic fields and with the sensor coils sensing the corresponding MBN as described above) and the tool output or collected data is monitored to detect any change in the MBN or MEA as compared to what was measured during the tool's descent. An increase in MBN, or a change in the MEA, as stress is induced into the well pipe, indicates the tool is still above the freepoint and should be lowered further into the well pipe. When the tool reaches a point where inducing stress no longer precipitates increasing MBN, the tool is raised and used to record data during the ascent. During the ascent, an operator may observe the collected data, and may compare the ascending log with the log made during the descent (or a processor may electronically or digitally compare the data to determine any changes or differences between the data). The operator may be able to visibly discern a notable difference between the two logs. A sudden change in appearance, character or values between the two logs indicates that the tool is at or is passing the freepoint. In particular, a marked change of MEA as indicated by a comparison of the logs indicates the location of the freepoint. In other situations, it is foreseen that computer analysis software may be employed to more accurately compare the data or to analyze data from a single log to determine the freepoint. As shown in FIG. 13, data may be obtained by a freepoint detection tool that pertains to the MEA along the well pipe and plotted for analysis. The vertical axis of the graph of theoretical data in FIG. 13 represents the angle of the Magnetic Easy Axis (MEA) and the horizontal axis indicates the distance into the well.

As the tool ascends along the well pipe, the data collected from the lower portion of the well pipe below the freepoint closely matches data from the descent log. When the tool reaches the freepoint, the difference between the two logs becomes readily apparent. Once the location of the freepoint is determined (which may be determined by determining the distance that the tool has traveled downward or along the well pipe (such as in response to an output of an odometer device or position locating device or the like of the tool) for the location of the tool that corresponds to the detected freepoint), the tool may be removed from the well pipe or may be used to detect the next collar above the freepoint. After the tool is removed from the well pipe, a back-off operation may be performed to remove the section or sections of well pipe above the detected freepoint.

The freepoint detection process of the present invention is described herein as moving or lowering the tool in a first or downward direction and then moving or raising the tool in a second or upward direction after and while the well pipe is stressed. However, it is envisioned that the well pipe may be first stressed prior to the first pass of the tool along the well pipe, whereby the second pass of the tool detects the magnetic Barkhausen noise of the unstressed or less stressed well pipe, and it is further envisioned that the tool could be first raised from an initial lowered point and then lowered after and while the well pipe is stressed, or that any other orders of processes may be implemented, while remaining within the spirit and scope of the present invention. Optionally, for example, the tool may be moved twice in the same direction, with one pass being while the well pipe is unstressed and the other pass being while the well pipe is stressed, while remaining within the spirit and scope of the present invention. Although the term "unstressed" is used herein, clearly this is not intended to refer only to a pipe that is wholly unstressed, but is intended to refer to a pipe that is less stressed during one pass of the tool than a degree of stress that is applied to the pipe for the other pass of the tool.

In the illustrated embodiment, the sensor assemblies are arranged and spaced circumferentially around a generally cylindrical housing or chassis and in a single row or level of sensor assemblies. The sensors are rotatable so that each section of the pipe wall adjacent to or at or near the respective sensor assembly is exposed to a full or near full rotation of the sensor as the tool passes any given point or region of the well pipe. However, other arrangements of sensor assemblies may be implemented while remaining within the spirit and scope of the present invention.

Figure 9:
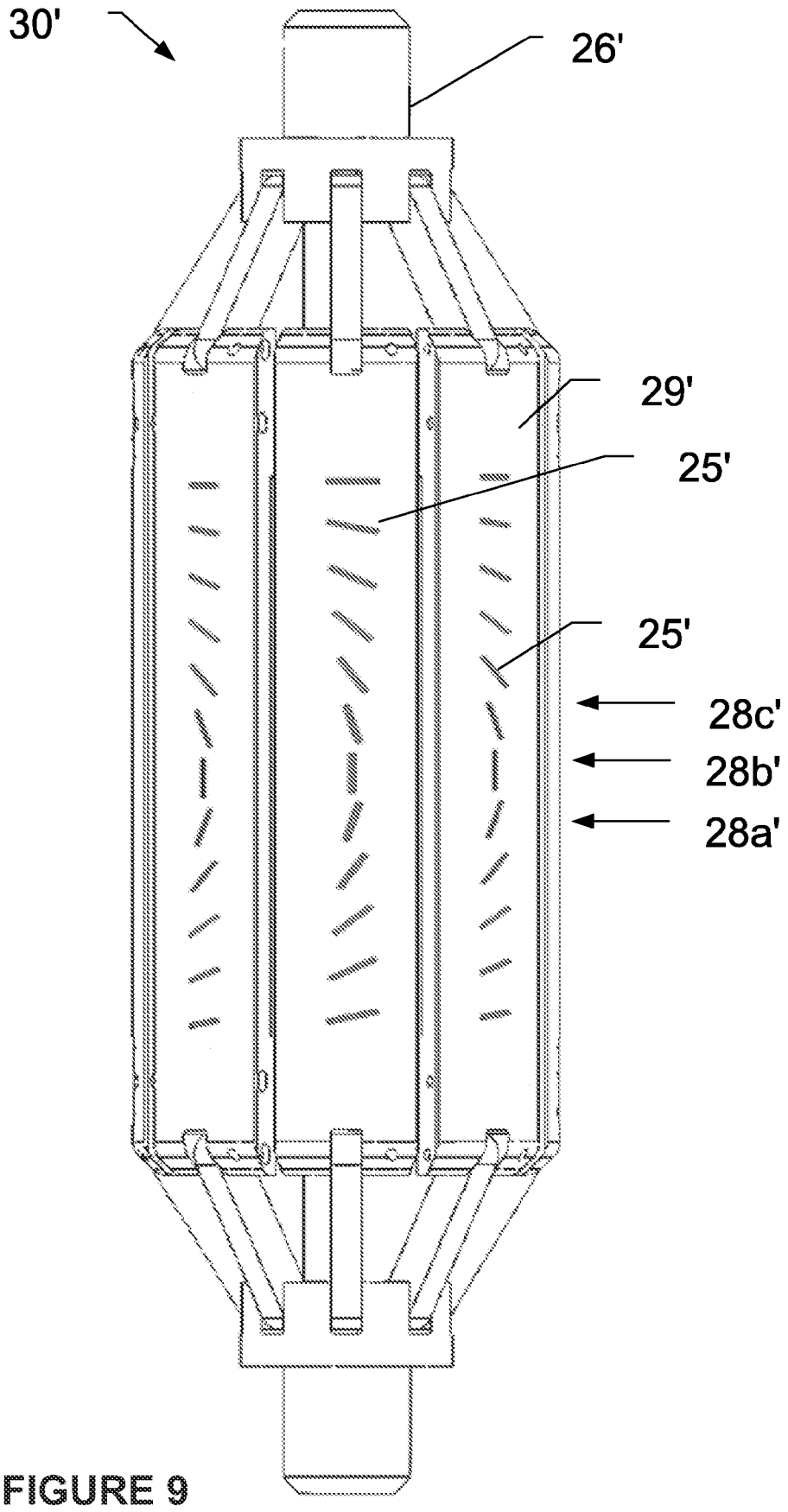
FIG. 9 is conceptual view of another freepoint detection tool of the present invention, illustrating the relative orientation of fixed sensors on a fixed sensor freepoint detection tool.

For example, and with reference to FIG. 9, it is envisioned that an alternative method of construction of a freepoint detection tool of the present invention is to replace the single row of rotating sensor assemblies with multiple rows of non-rotating sensor assemblies 25' arranged along a chassis or housing 26' of a freepoint detection tool 30' (such as along respective shoes 29' of the detection tool 30'). The rows of non-rotating sensor assemblies may be arranged at the outer surface or portion of the housing 26' and spaced apart along the longitudinal axis of the tool. Preferably, but not necessarily, the sensors of each row may be equally spaced around the circumference of the tool. The number of sensor assemblies in each row and the number of rows may vary depending on the size of the well pipe to be inspected and the desired resolution of the freepoint detection tool. The chassis and shoes of the detection tool 30' may be otherwise substantially similar to the chassis and shoes of detection tool 30, discussed above, such that a detailed discussion of the detection tools need not be repeated herein.

To provide a full range of data, the sensors in each respective row or ring of sensors may be oriented in the same direction, while each sensor has a different orientation relative to the sensors of other rows of sensors along the longitudinal axis of the chassis and well pipe. The sensors are systematically oriented differently from the sensors of the other rows by systematically placing the sensors for each of the rows of sensors of the tool with the sensor coils of each row of sensors oriented in a different direction, such that the sensor orientation varies from a fixed sensor in one row to a next fixed sensor of the adjacent row of sensors and so on. The sensor orientation thus varies from one fixed sensor to the next fixed sensor of an adjacent row of sensors and along the longitudinal axis of the chassis for each given radial or circumferential location of sensors. For example, and with reference to FIG. 9, a row 28*a*' of fixed sensors 25' may be oriented with the sensors being generally vertical or generally along or generally parallel to the longitudinal axis of the chassis or housing 26', while an adjacent row 28*b*' of fixed sensors 25' may be oriented with each of the sensors being angled relative to the longitudinal axis of the chassis or housing 26', and a third row 28*c*' of fixed sensors 25' may be oriented with each of the sensors being further angled relative to the longitudinal axis of the chassis or housing 26' and so on (and optionally in both directions as shown in FIG. 9). As can be seen in FIG. 9, each column of sensors along a particular portion of the cylindrical housing 26' includes sensors that collectively have multiple different orientations, such as orientations at various angles between about +/−90 degrees relative to the longitudinal axis of the housing 26'.

Thus, as the freepoint detection tool 30' is lowered into and along the well pipe and not rotated relative to the well pipe, the sensor orientation changes relative to each particular location along the well pipe. The sensor orientation is thus effectively rotated in a plane that is tangential to the outside of the tool body or chassis and that is parallel to the longitudinal axis of the tool. The incremental change in sensor angle or orientation along the detection tool may be selected depending on the number of sensors in each row of sensors and/or the number of rows of sensors along the freepoint detection device or tool.

As the tool translates through the well pipe, the tool systematically energizes the electromagnetic coils and samples data from the associated sensor coil to record MBN. For example, the system may energize each of the sensors of a particular row, such as the bottom row if the device is descending along a generally vertical well pipe, and sample data from the associated sensor coils, and may then energize each of the sensors of the next adjacent row of sensors, such as the sensor row immediately above the bottom row, and sample data from the associated sensor coils, and so on, as the tool is lowered down along the well pipe. The data collected by the tool is then processed to align the data from the sensors of each column of sensors (to account for the placement position along the length of the tool) and then analyzed to determine the angle of the magnetic easy axis of the well pipe.

Therefore, the present invention provides a freepoint detection tool and system and method that utilizes detection of magnetic Barkhausen noise along the well pipe or section of well pipe to determine the location of the freepoint of the well pipe or section of well pipe. The tool induces a magnetic field at or near the pipe wall (such as via one or more electromagnetic coils disposed at or near the pipe wall) and detects the corresponding or resulting magnetic Barkhausen noise (such as via one or more sensor coils disposed at or near the pipe wall). The data indicative of the magnetic Barkhausen noise is used to determine the location of the freepoint of the well pipe.

The present invention is capable of conducting Barkhausen noise surveys in pipes installed within, or anchored to the Earth, such as downhole well casings, drill strings, or construction members. Following a baseline survey, such pipes may be subjected to a change in stress produced by pipe movement or deformation that may be detected by subsequent Barkhausen noise surveys. Such stresses, as may result from structural forces, geothermal expansion forces, mechanically applied forces, or geologic forces or the like, which act directly on the pipe via geologic strata or which may act on other materials in direct contact with the pipe, such as cement or grout or the like, may modify the pipe stress conditions to varying degrees. In addition to geologic forces, such stresses may result from other forces, such as ocean currents, tides and wind and/or the like, that act directly on the pipe or structural members. Because such stresses are known to be precursors to a variety of undesirable pipe conditions, such as buckles, bends, dents, ripples, ovalities, wrinkles, splits, collapses and other failure modes, the identification of pipe intervals experiencing excessive stress, increasing stress, or a change in stress is desirable in order to monitor or maintain pipe structural integrity through remediation or other means of intervention.

Optionally, the stress detecting system of the present invention may detect stresses along a pipe to generate a stress profile for a pipe, and the system may initially generate a first or baseline stress profile for a pipe (such as when the pipe is initially installed or at any time after installation), and may later detect stresses along the pipe to generate a second or later or subsequent stress profile. The system may then compare the second stress profile to the baseline stress profile to determine whether any changes (and the degree of such changes) have occurred in the stress along the pipe since the baseline stress profile was generated. The system may then determine locations where stresses have changed along the pipe and may continue to monitor those locations or may generate an alert or output indicative of the stress detections (such as a display of stresses or the like that is remote from the tool and pipe, such as at a remote facility or the like) so that those pipe locations may be addressed and/or corrected or repaired.

Figure 14A:
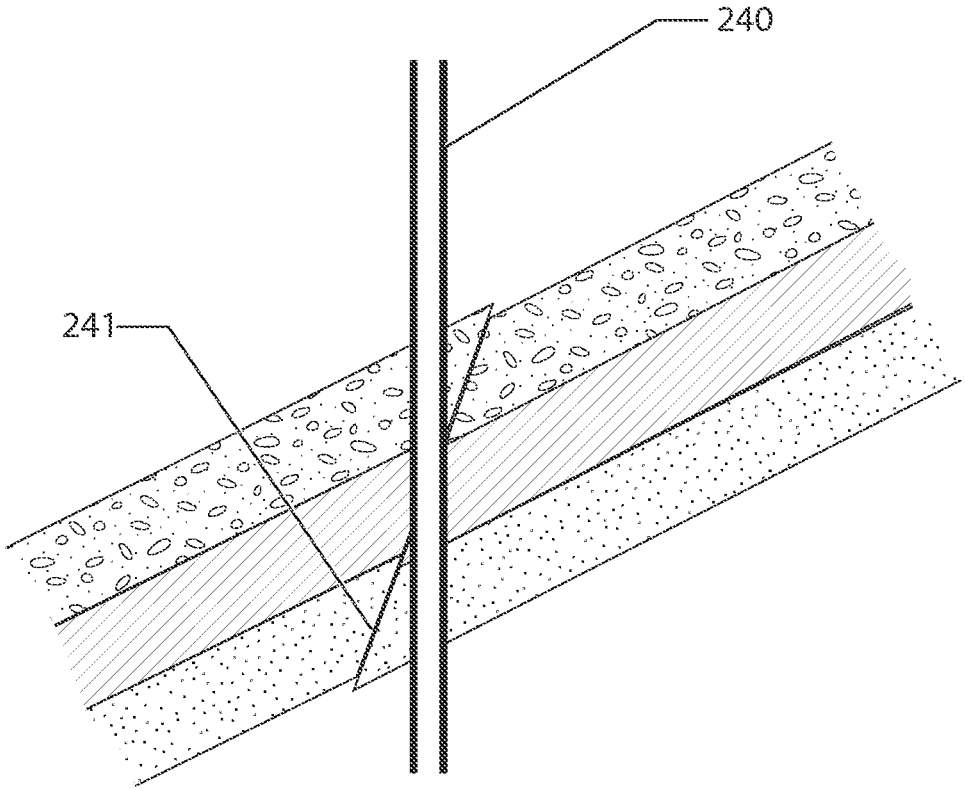
FIG. 14A is a simplified cross section of a well pipe located in a fault zone, with features such as multiple casing strings, cemented annular spaces and/or the like omitted.
Figure 14B:
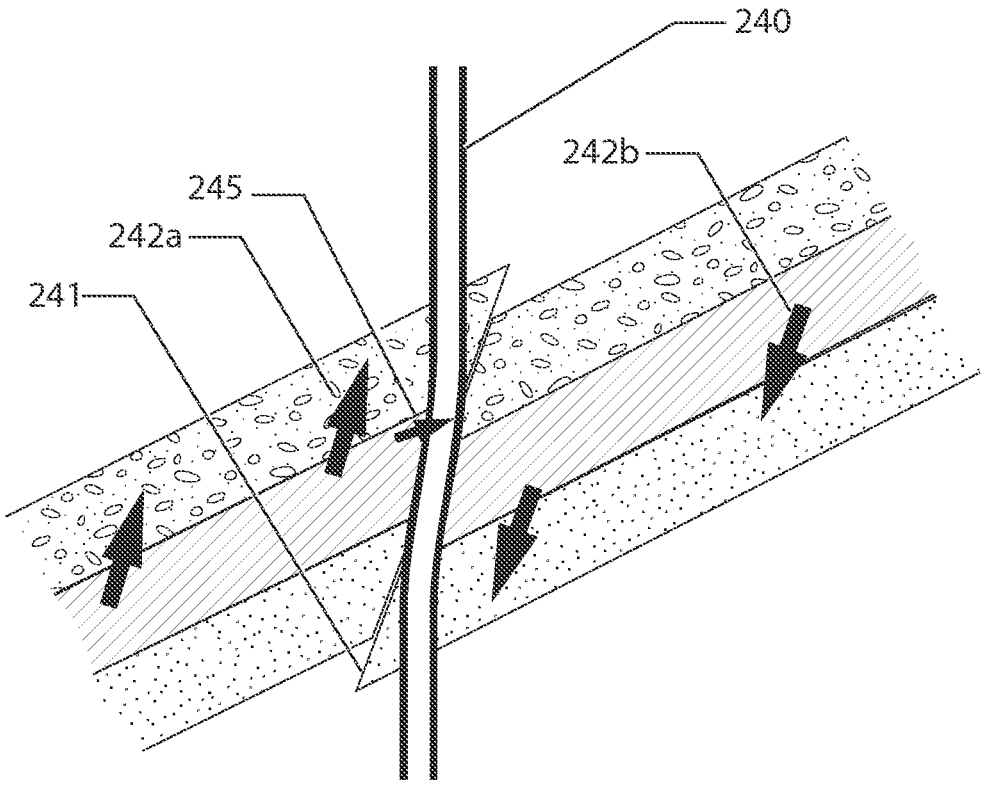
FIG. 14B is another simplified cross section of the well pipe of FIG. 14A, showing the pipe subjected to thrusting of the fault after the pipe was in place.

For example, and with reference to FIG. 14A, a pipe 240 may be disposed in the ground at or near a fault line 241. Fault lines 241 are known to sometimes create traps, making them potential prospects for hydrocarbon production. Due to the nature of faults, one side of the fault moves in relationship to the other. In the example shown in FIG. 14B, the left side of the fault shows upward movement 242*a* of the rock strata and the right side shows downward movement 242*b* of the rock strata. Pipe 240 extending through the fault 241 can be subjected to a combination of compression forces and tensile forces (such as shown at 245 in FIG. 14B), which can stretch, compress, or bend the pipe. For example, and as shown in FIG. 14B, one potential outcome of the shifting strata is a bending of the well pipe 240. Where the pipe has been bent, the pipe is subject to tensile and compression forces that may be identified through a Barkhausen Noise inspection, such as in a similar manner as described above. This example shows only one type of relative movement of rock strata produced by a geologic fault. It should be anticipated that relative movement in other directions, such as lateral movement or diagonal movement in other axes that would produce similar pipe deformation, could, in turn, be detectable by a Barkhausen Noise survey in accordance with the present invention.

Figure 15:
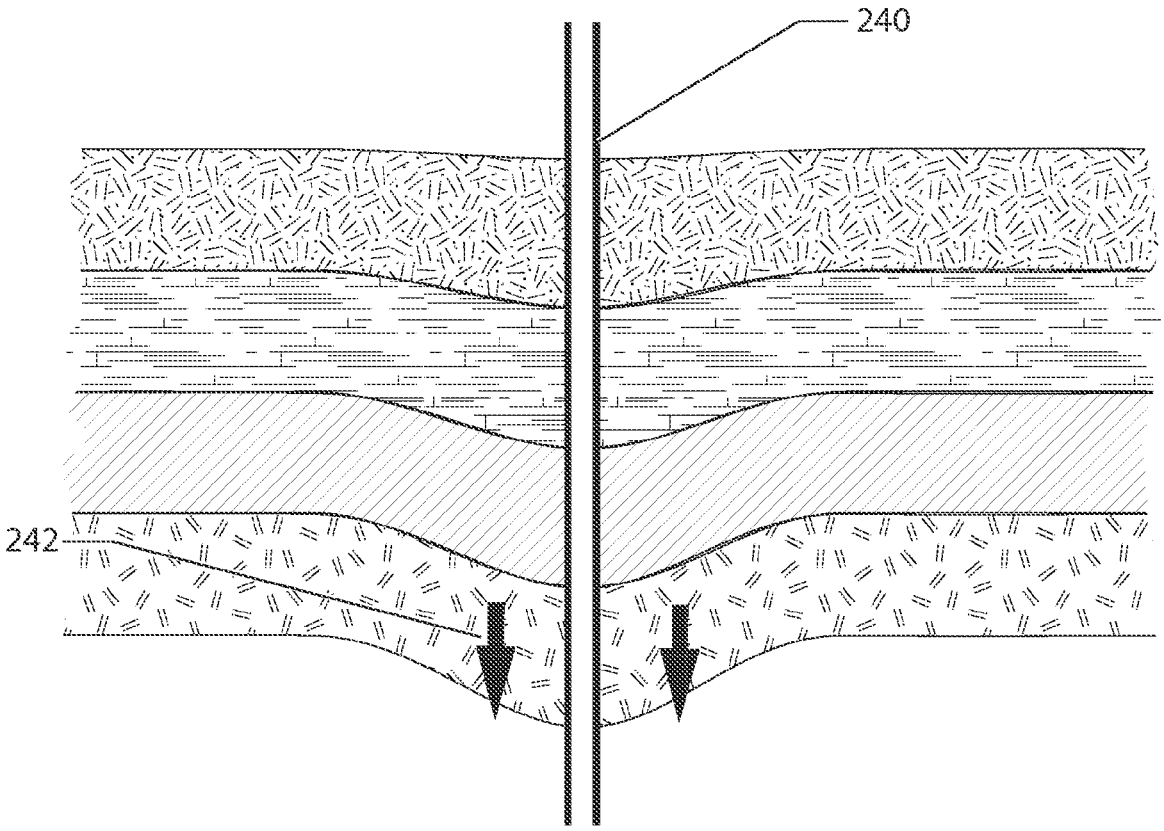
FIG. 15 is a simplified cross section of a well pipe that is subjected to subsidence, with features such as multiple casing strings, cemented annular spaces and/or the like omitted.

For example, and with reference to FIG. 15, geological subsidence can occur when sufficient hydrocarbons are pumped from the ground and cause material above the reservoir to settle. The vertical movement (such as shown by arrows 242 in FIG. 15) of the material may cause compression or tension on the pipe 240 depending on relative movements of various strata. Subsidence may also be caused by mining, dissolution of limestone or groundwater removal or the like. If wells are located in areas where these causes of subsidence are present, the well pipe 240 may be subjected to such compression or tension, creating areas in the pipe where Barkhausen noise surveys may detect deformation of the pipe.

Figure 16A:
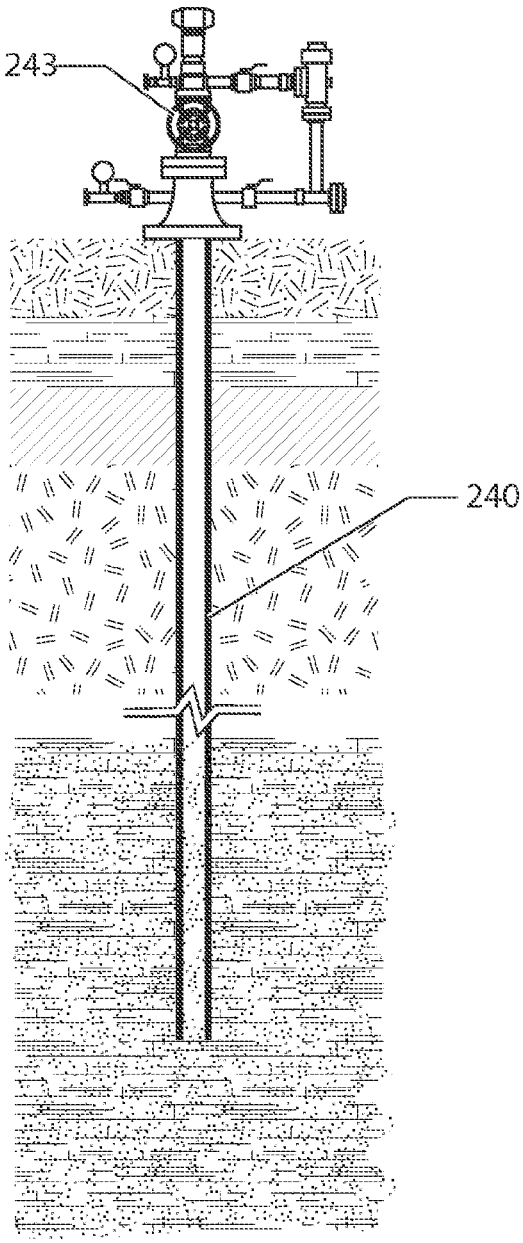
FIG. 16A is a simplified cross section of a well pipe and wellhead extending from the earth's surface into a zone of geothermal heat, with features such as multiple casing strings, cemented annular spaces and/or the like omitted.
Figure 16B:
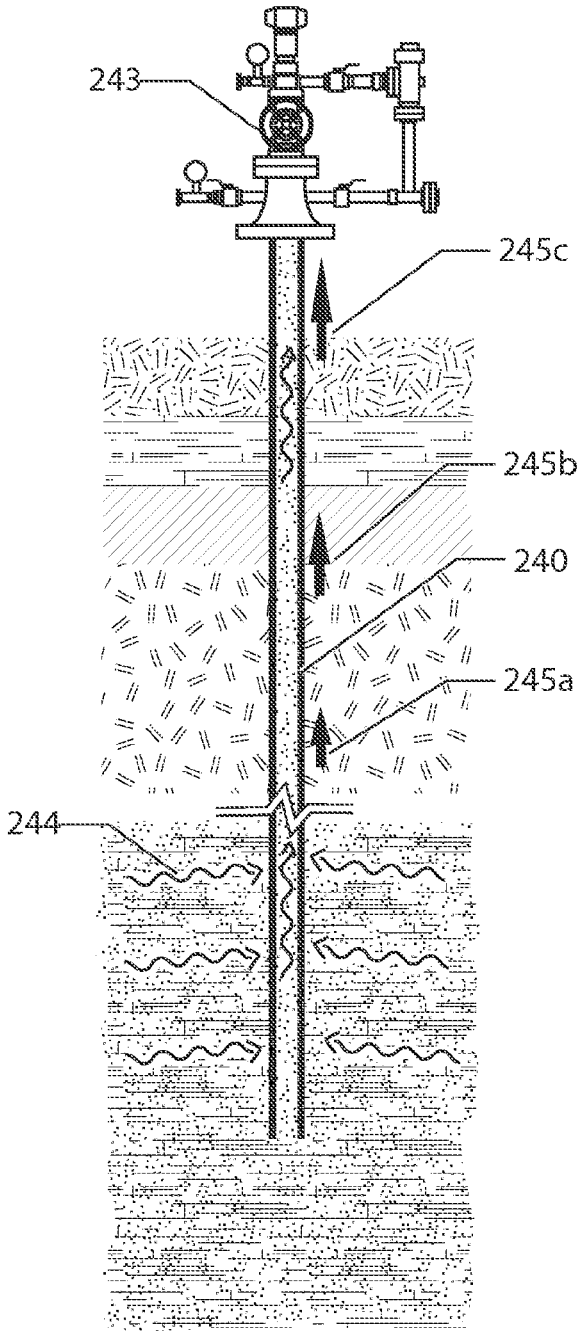
FIG. 16B is another simplified cross section of the well pipe of FIG. 16A, showing the pipe subjected to differential geothermal expansion.

FIG. 16A shows a simplified cross section of a well pipe 240 used to extract fluid from a reservoir located in an area where geothermal heat may be present. Prior to production, the temperature differential between the pipe and the surrounding earth material is negligible. However, when the fluid is extracted through the well, geothermal heat (such as represented by arrows 244 in FIG. 16B) is transferred, along with the fluid, creating a greater temperature differential between the pipe and the surrounding strata. The heating of the pipe wall causes the pipe to expand diametrically and longitudinally. With wells extending several thousand feet into the ground, longitudinal expansion may cause vertical pipe movement (such as represented by the arrows 245*c* in FIG. 16B) and wellhead movement of several feet at the surface. Pipe expansion 245*a* at greater depths will typically not be as significant as pipe expansion 245*b* in the middle regions of the pipe 240. As the pipe expands and contracts, well pipe 240 may be subject to tensile and compressive forces, creating stressed regions in the pipe. Barkhausen Noise surveys may identify areas where the pipe has been stretched or compressed responsive to such temperature changes at or near or in the pipe or wall of the pipe.

Figure 17:
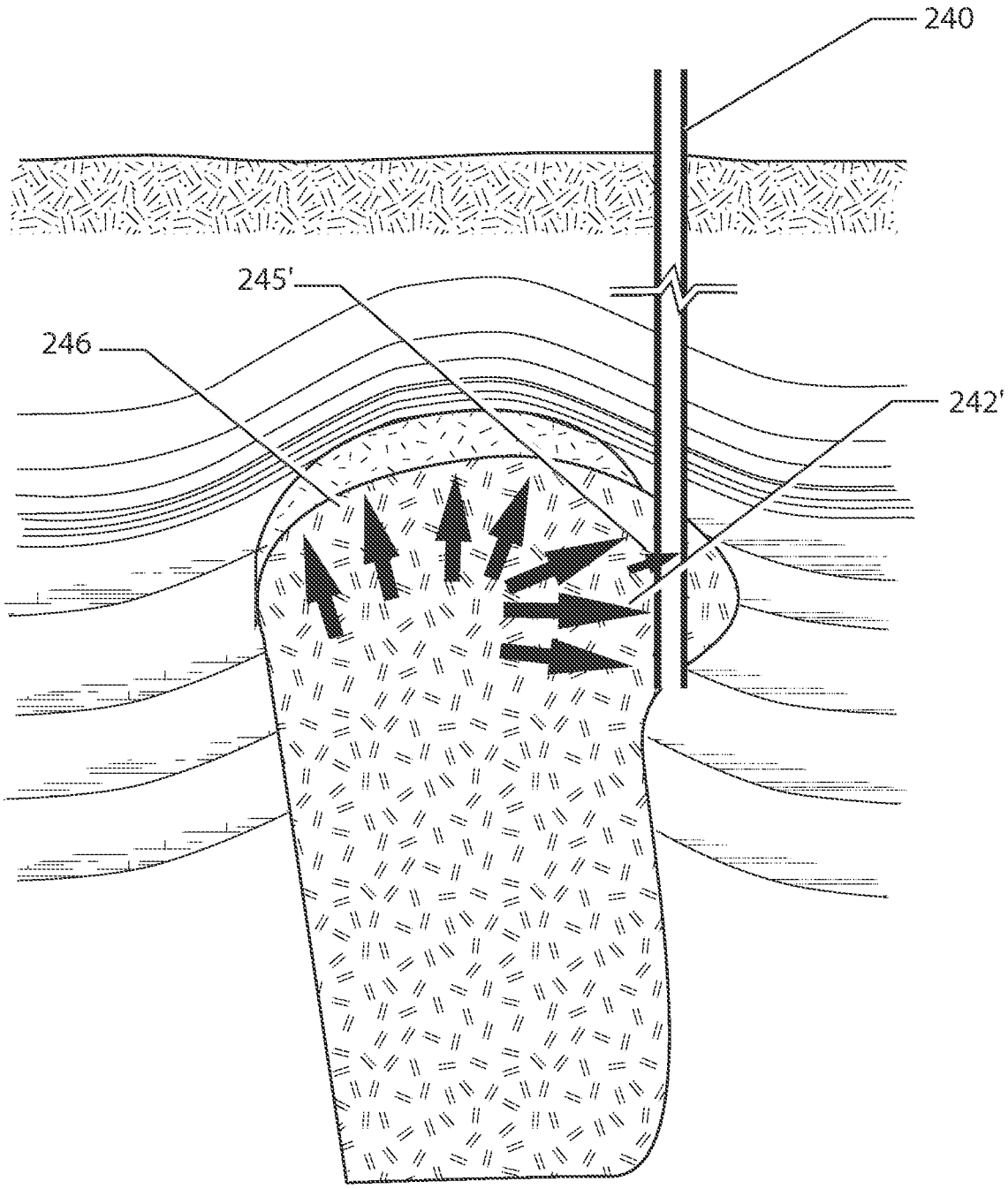
FIG. 17 is a simplified cross section of a well pipe extending from the surface of the earth into the edge of a salt dome, with features such as multiple casing strings, cemented annular spaces and/or the like omitted.

Another example of geological movement is a salt dome 246 as illustrated in FIG. 17. Generally, rock has a higher density than salt deposits. The higher density causes solid rock to settle toward the center of the earth at a faster rate than salt. Salt, being less dense than rock, tends to be more buoyant than rock, giving the salt a tendency to rise through rock layers. This action causes the salt to form a plume through rock strata, similar to smoke rising through the atmosphere. In geological time, salt migrates quite rapidly and can move a significant distance during the production lifetime of a well. As the salt dome rises through the surrounding rock, some rock layers, which are more resistant to salt movement, may cause the salt dome to migrate outward from the center of the plume. For example, and with reference to FIG. 17, the outward migration (such as represented by arrows 242') may cause a movement 245' or deformation of a well pipe 240 adjacent to the salt dome. A Barkhausen noise survey may be useful in detecting such deformation.

In each of these examples, it should be noted that well casings, cemented annular spaces, grout, or well appurtenances or the like may be acted upon by such geological movements or forces. The forces and movement can be transferred through the well features and thus subject the well pipe to movements and forces in a manner similar to what would occur if the movements and forces were to directly act upon the well pipe itself. Thus, the Barkhausen noise analysis and system of the present invention is suitable for applications where the pipe is in direct contact with the geological formations and the like in the ground and where the pipe may be encased in well casings and the like in the ground.

Figure 18A:
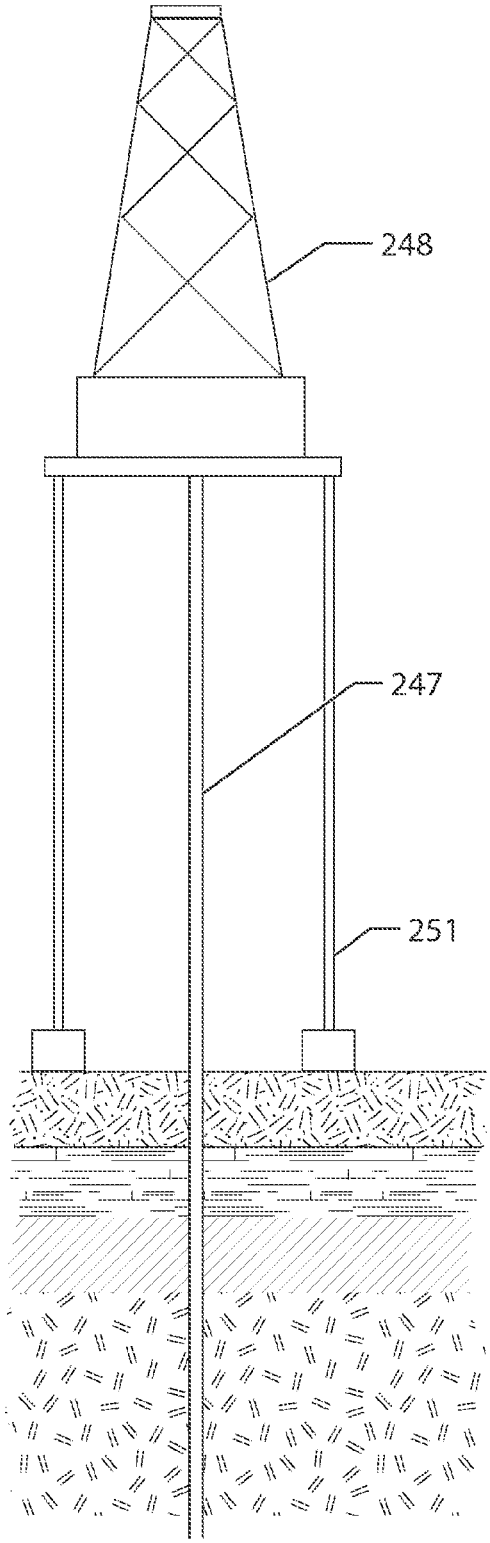
FIG. 18A is a simplified cross section of a jack-up drilling rig standing on the ocean floor, with features such as multiple casing strings, cemented annular spaces and/or the like omitted.
Figure 18B:
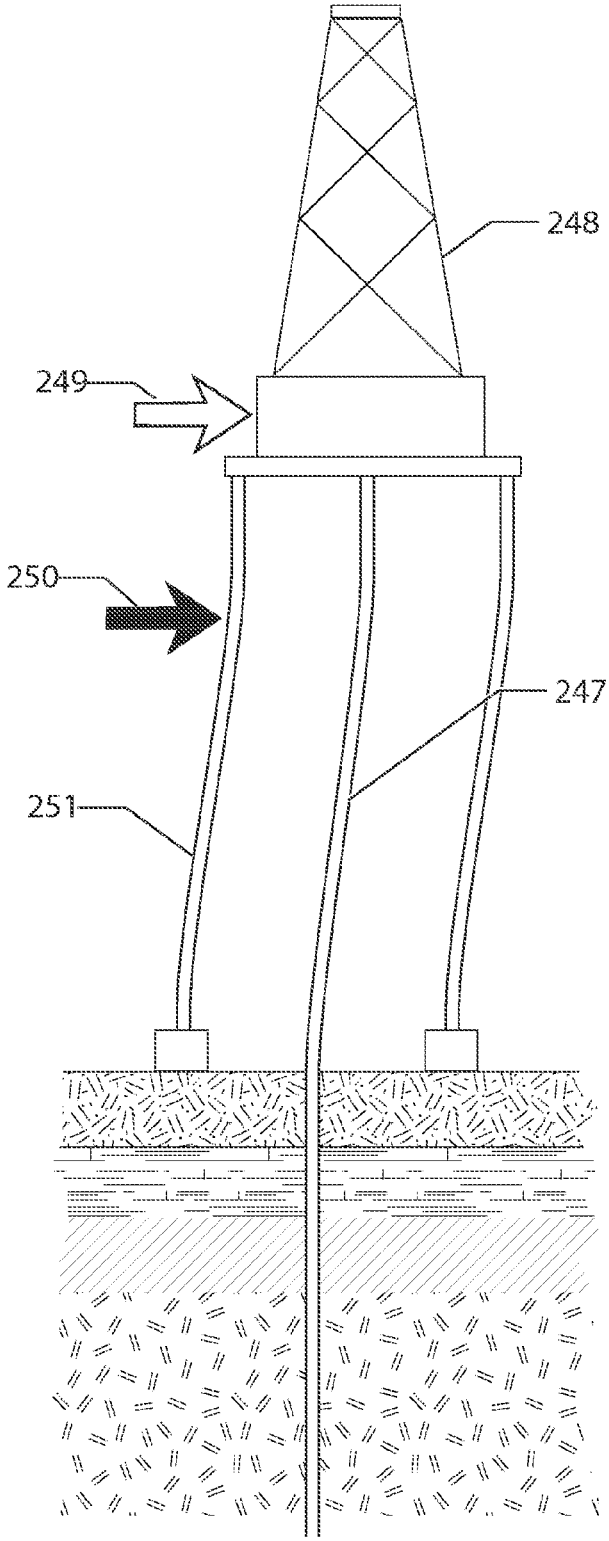

In still another example, referring to FIG. 18A, offshore oil facilities or platforms, such as drilling rigs (such as shown at 248 in FIGS. 18A and 18B), and production platforms (whether semi-submersible, jack-up platform, or floating vessel types of platforms or rigs) work in water of varying depths. Wind, ocean currents and tides exert forces on these platforms and the associated well pipes, drill strings 247 and structural members 251 extending downward from the platforms to the ocean floor, or below. FIG. 18B shows an exaggerated effect of wind 249 and ocean currents 250 causing the offshore platform 248 to be urged from a position directly over the point where the drill string 247 enters the ocean floor. This movement may create stresses in the drill string 247 and structural members 251 that may be identified through a Barkhausen noise survey. Similar forces may act upon production platforms, semi-submersible rigs and surface vessels, creating conditions where a Barkhausen noise survey may be useful.

The present invention thus is capable of conducting Barkhausen noise surveys in pipes installed within the Earth, such as downhole well casings or construction members. The system may first be used to conduct a baseline survey or analysis of the pipe and, following such a baseline survey, the pipe over time may be subjected to a change in stress, such as may be caused by pipe movement or deformation due to changes in geological conditions, including geological shifting or movement or geological temperatures or the like. The change in stress may be detected by subsequent Barkhausen noise surveys, where the later or subsequent surveys or analyses may be compared to the baseline detections or surveys to determine the locations along the pipe where changes in pipe stress has occurred. Such stresses, as may result from structural forces, geothermal expansion forces, mechanically applied forces, or geologic forces which act directly on the pipe via geologic strata, or which may act on other materials in direct contact with the pipe, such as cement or grout or casings, can be detected or determined by the inspection system of the present invention. Because such stresses are known to be precursors to a variety of undesirable pipe conditions such as buckles, bends, dents, ripples, ovalities, wrinkles, splits, collapses and other failure modes, the identification of pipe areas or intervals that may be experiencing excessive stress, increasing stress, or a change in stress is desirable in order to monitor or maintain pipe structural integrity through remediation or other means of intervention.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A stress detecting system operable to detect stresses in a conduit, said stress detecting system comprising:

a tool movable along a conduit and operable to generate a magnetic field;

wherein said tool is operable to sense magnetic Barkhausen noise within the conduit in response to said tool generating the magnetic field; and wherein said stress detecting system is operable to detect a change in stress along the conduit responsive to an output of said tool indicative of the sensed magnetic Barkhausen noise.

2. The stress detecting system of claim 1, wherein said tool comprises a magnetic element for generating the magnetic field.

3. The stress detecting system of claim 1, wherein said tool is moved along and within the conduit.

4. The stress detecting system of claim 1, wherein said tool generates said magnetic field and said tool senses magnetic Barkhausen noise as said tool moves along the conduit.

5. The stress detecting system of claim 1, wherein the conduit is disposed in the ground and wherein said stress detecting system is operable to detect a change in stress along the wall of the conduit caused by geological changes at or near the conduit.

6. The stress detecting system of claim 5, wherein said stress detecting system is operable to detect a change in stress along the wall of the conduit caused by geological changes at or near a casing that substantially encases the conduit in the ground.

7. The stress detecting system of claim 1, wherein said stress detecting system is operable to detect a change in stress along the wall of the conduit caused by geological shifting at or near the conduit.

8. The stress detecting system of claim 1, wherein said stress detecting system is operable to detect a change in stress along the wall of the conduit caused by geological subsidence.

9. The stress detecting system of claim 1, wherein said stress detecting system is operable to detect a change in stress along the wall of the conduit caused by temperature changes at or near or in the conduit.

10. The stress detecting system of claim 1, wherein said stress detecting system is operable to detect a change in stress along the wall of the conduit caused by migration of salt at or near the conduit.

11. The stress detecting system of claim 1, wherein the conduit is disposed at an offshore platform and wherein said stress detecting system is operable to detect a change in stress along the wall of the conduit caused by at least one of water current, waves, tides and wind.

12. The stress detecting system of claim 1, wherein said stress detecting system is operable to detect a change in stress along the conduit to determine parts of the conduit where stress is greater than at other parts of the conduit.

13. The stress detecting system of claim 1, wherein said stress detecting system compares a stress profile of a conduit to a baseline stress profile to determine changes in stress along the conduit since the baseline stress profile was generated.

14. A method of detecting stress in a conduit, said method comprising:

providing a tool;

moving said tool along a conduit;

said tool generating a magnetic field as said tool moves along the conduit;

said tool sensing magnetic Barkhausen noise in the conduit responsive to generation of the magnetic field; and determining stresses along the conduit responsive to an output of said tool indicative of the sensed magnetic Barkhausen noise.

15. The method of claim 14, wherein generating a magnetic field comprises inducing a magnetic field in a wall of the conduit via a magnetic element of said tool.

16. The method of claim 14 further comprising collecting data indicative of the magnetic Barkhausen noise sensed along the conduit by said tool.

17. The method of claim 14, wherein determining stresses along the conduit comprises (i) determining stresses along the conduit during a first pass of said tool along the conduit to generate a first stress profile of the stresses along the conduit, and (ii) determining stresses along the conduit during a second pass of said tool along the conduit to generate a second stress profile of the stresses along the conduit, and wherein said method comprises comparing the second stress profile to the first stress profile to determine changes in stresses along the conduit that occurred between the first and second pass of conduit tool along the conduit.

18. The method of claim 14, wherein moving said tool along a conduit comprises moving said tool along and within the conduit.

19. The method of claim 14, wherein the conduit is disposed in the ground and wherein determining stresses along the conduit comprises determining changes in stress along the conduit caused by geological changes at or near the conduit.

20. The method of claim 19, wherein determining changes in stress along the conduit comprises determining changes in stress along the conduit caused by at least one of (i) a geological shifting at or near the conduit, (ii) geological subsidence at or near the conduit, (iii) temperature changes at or near or in the conduit and (iv) migration of salt at or near the conduit.

21. The method of claim 14, wherein the conduit is disposed at an offshore platform and wherein determining stresses along the conduit comprises determining changes in stress along the conduit caused by at least one of water current, waves, tides and wind.

22. The method of claim 14, wherein determining stresses along the conduit determining changes in stress along the conduit to determine parts of the conduit where stress is greater than at other parts of the conduit.

* * * * *